United States Patent [19]

McMahon

[11] Patent Number: 4,981,316

[45] Date of Patent: Jan. 1, 1991

[54] ROD ELEVATOR INSERT

[75] Inventor: Jeffery C. McMahon, Sheffield, Tex.

[73] Assignee: Marathon Oil Company, Findlay, Ohio

[21] Appl. No.: 401,341

[22] Filed: Aug. 31, 1989

[51] Int. Cl.[5] ..... B66C 1/66; E21B 19/06

[52] U.S. Cl. ..... 294/90; 294/902

[58] Field of Search ..... 294/1.1, 82.1, 86.1, 294/86.26, 86.33, 90–92, 102.2, 113, 119.2, 902; 188/67; 285/140–148

[56] References Cited

U.S. PATENT DOCUMENTS

| | | | |
|---|---|---|---|
| 1,622,537 | 3/1927 | Neilson | 294/91 |
| 1,642,628 | 9/1927 | Philbrick | 294/90 X |
| 1,685,713 | 9/1928 | Moody | 294/91 |
| 2,384,331 | 9/1945 | Neilson | 294/91 |
| 2,994,551 | 8/1961 | Garnett | 294/90 X |
| 3,202,450 | 8/1965 | Servis | 294/91 |
| 3,353,235 | 11/1967 | Adams | 294/102.2 X |
| 3,368,252 | 2/1968 | Meek | 294/102.2 |
| 3,527,094 | 9/1970 | Yew et al. . | |
| 3,902,751 | 9/1975 | Burkepile et al. | 294/92 |
| 4,483,564 | 11/1984 | McDaniel | 294/91 |
| 4,823,919 | 4/1989 | Hayatdavoudi | 294/102.2 X |

*Primary Examiner*—Johnny D. Cherry

*Attorney, Agent, or Firm*—Jack L. Hummel; Jack E. Ebel

[57] ABSTRACT

An insert for use in a rod elevator assembly. The insert is coated with a fusion-bonded nylon coating which is resistant to damage from the rod and which does not damage the plastic coating on the rod. Both inserts in a two-insert assembly are coated, and all surfaces of the inserts may be coated.

14 Claims, 2 Drawing Sheets

ROD ELEVATOR INSERT

FIELD OF THE INVENTION

This invention relates to an elevator assembly for use in lifting a rod from or lowering it into a well. More particularly, it relates to a rod elevator insert for use in the assembly.

BACKGROUND OF THE INVENTION

Rod elevators have long been used to support sucker rods as they are run into and out of a well. Their basic design has remained substantially the same over that period of time. The elevator assembly is provided with a vertically oriented opening that extends out to one side of the assembly. The opening is larger than the diameter of the rod to allow the elevator to be positioned by moving it laterally onto the rod. Typically, the elevator includes an insert which also contains an opening aligned with the main elevator opening. Commonly, a standard size elevator is provided with a number of inserts of varying sizes, enabling a single elevator to be used to lift or lower sucker rods of different diameters. The width of the insert opening is somewhat smaller than the width of the elevator opening so as to fit more snugly about the sucker rod at the juncture between the elongated rod shaft and the thicker head portion. Thus when the elevator is raised, the insert structure surrounding the rod engages the bottom of the head portion of the rod to support the weight of the rod.

The heavy weight of the sucker rod against the small supporting area of the elevator insert during the rod raising or lowering operation causes high compressive forces to exist at this support area. In addition, if the elevator insert opening is not aligned with the rod during relative lateral movement between the rod and the elevator, the insert tends to scrape and bump against the rod during this operation. These actions are undesirable because they often result in damage to the plastic rod coating used to protect the metal rod against corrosion caused by contact with well bore fluids. If such coatings are damaged, the resulting corrosion will normally result in rod failure.

Since damage to the rod coating is inevitable when there is contact between the metal elevator and the sucker rod, repair procedures are commonly employed. This usually involves patching the rod coating by brushing a two-part epoxy onto the damaged area. The patch is not entirely effective, however, because of the difficulty in cleaning and drying the damaged area of the rod to the point required for proper adhesion of the epoxy.

Since the nature of the lifting operation is such that damage to the rod coating is likely to occur during the raising or lowering of sucker rods and since the conventional repair operation does not produce consistently acceptable results, some other means is needed to either better repair damaged rod coatings or prevent the damage from occurring in the first place.

BRIEF SUMMARY OF THE INVENTION

The invention provides a rod elevator assembly which protects the coating on a sucker rod against damage while being run into or out of a well bore, and is applicable to rod elevator assemblies which incorporate an insert adapted to engage a rod supported in the assembly. Basically, the insert is provided with a coating in the area contacting the rod which is capable of resisting damage from the rod and of cushioning the rod during lifting and lowering of the rod. The coating on the rod is thus protected against damage during the lifting and lowering operation.

In assemblies that incorporate two inserts, both inserts may be coated. Although any type of coating material capable of providing the necessary degree of protection may be employed, a nylon coating is preferred because of its toughness and its soft cushioning character.

The solution to the problem of rod corrosion resulting from damage to the rod coating thus involves a simple but highly effective economical design modification to the basic elevator assembly which was heretofore unavailable to the industry. It allows conventional procedures to be used when running a rod into and out of a well bore, and requires only that the special elevator inserts of the invention be used.

The above and other aspects of the invention, as well as other benefits, will readily be apparent from the more detailed description of the preferred embodiment of the invention which follows.

DESCRIPTION OF THE PREFERRED EMBODIMENT

Figure 1:
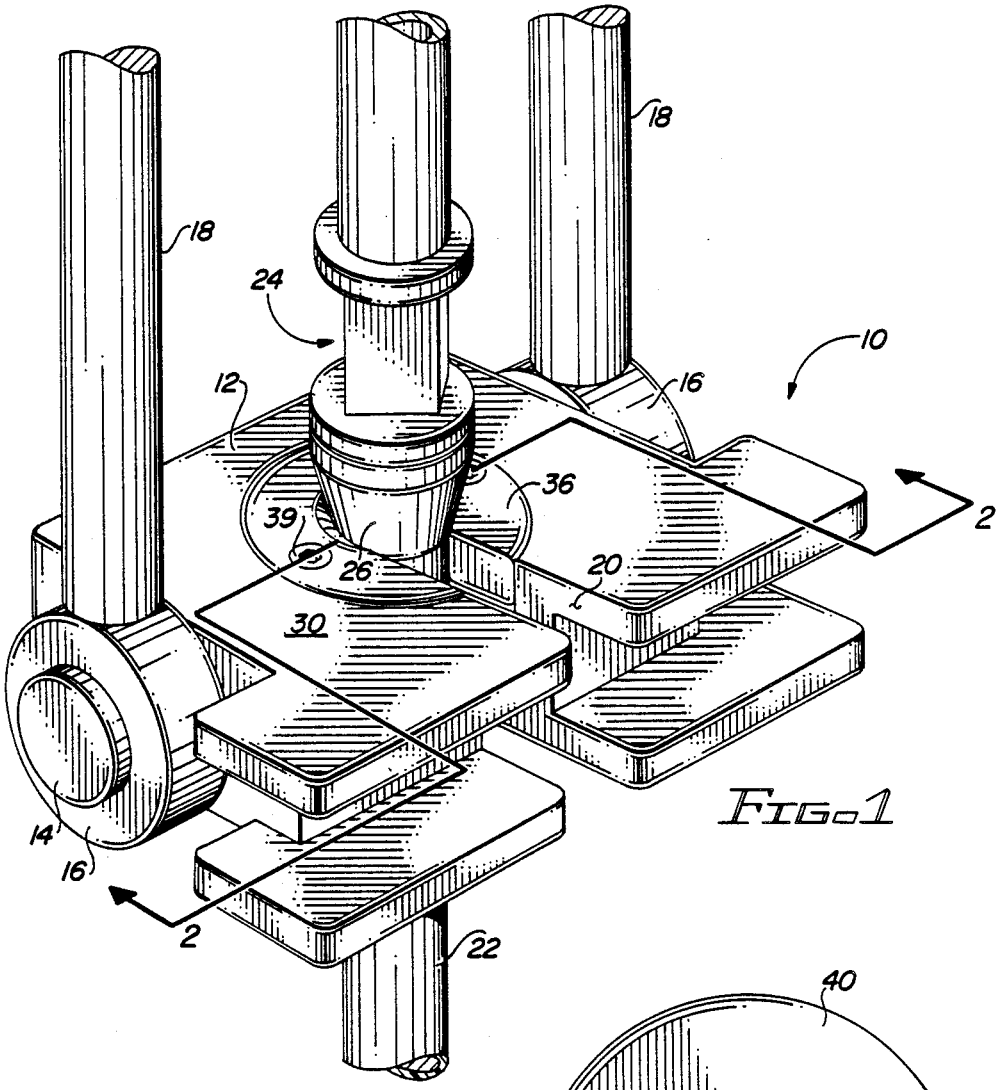
FIG. 1 is a pictorial view of the upper portion of a sucker rod in engagement with a rod elevator incorporating the insert of the invention.
Figure 2:
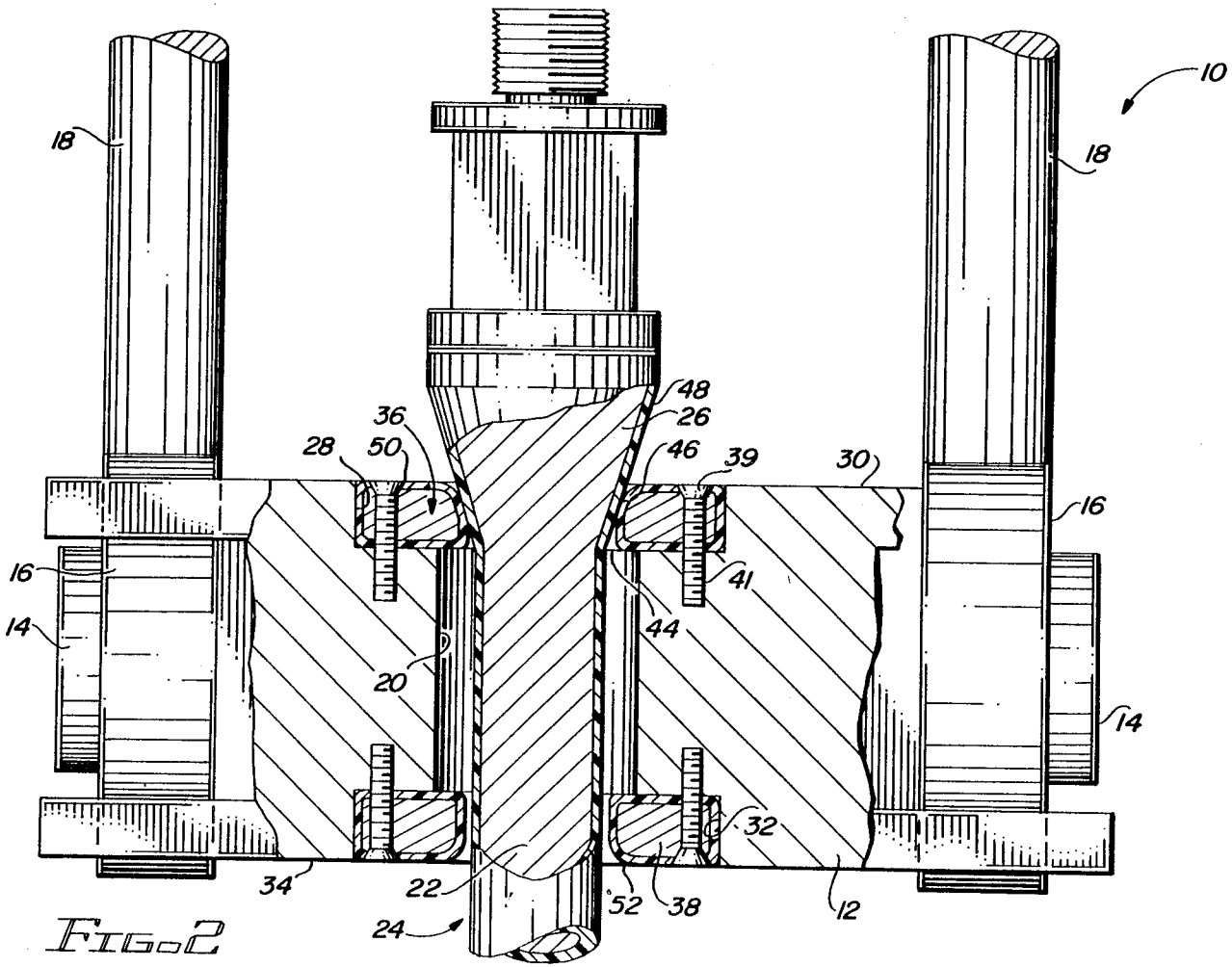
FIG. 2 is an enlarged transverse sectional view taken along line 2—2 of FIG. 1.

Referring to FIGS. 1 and 2, an elevator assembly 10 comprises a main body portion 12 having laterally extending pins or trunnions 14. Collars 16 mounted on the pins 14 are attached to the support rods 18 which lift the elevator assembly by power means, not shown. The main body portion 12 includes a slot-like opening 20 extending vertically throughout the elevator assembly. The width of the opening 20 is substantially greater than the diameter of the shaft 22 of sucker rod 24 so that the elevator assembly upon being moved laterally toward the sucker rod will readily allow entry of the rod into the opening. As is well known in the art, the elevator assembly is positioned with the wider head portion 26 of the sucker rod being located above the opening 20 so that, upon relative vertical movement between the elevator and the rod, the head portion 26 of the rod will be supported by the elevator assembly adjacent the top of the opening 20.

As best shown in FIG. 2, the main body portion 12 of the elevator has a recess 28 surrounding the end of the opening 20 adjacent the upper surface 30 of the elevator body. Similarly, the main body portion also includes a recess 32 surrounding the end of the opening 20 adjacent the lower surface 34 of the elevator body. Inserts 36 and 38 are received in the recesses 28 and 32, respectively, and are attached to the elevator body by bolts 39 in sockets 41 in the elevator body.

Figure 3:
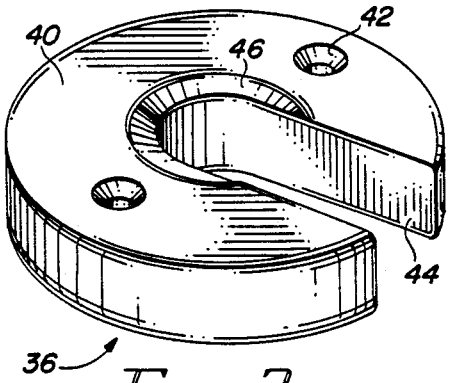
FIG. 3 is a pictorial view of a coated insert of the invention.
Figure 4:
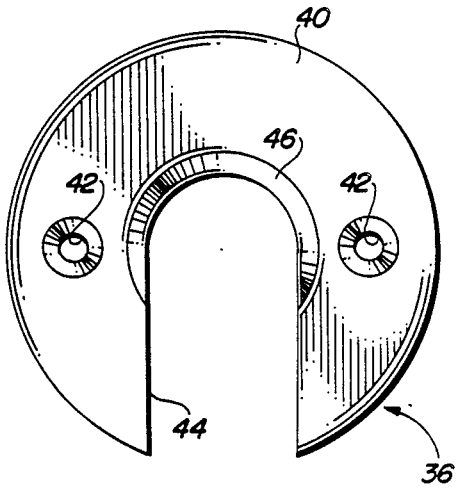
FIG. 4 is a top plan view of the coated insert of FIG. 3.

The inserts, as shown in FIGS. 3 and 4, comprise a generally circular body or disc 40 with bolt holes 42 extending through the disc on either side of an elongated slot 44. The slot 44 is aligned with the opening 20 of the elevator 10 when the inserts are mounted in the elevator recesses 28 and 30. As best seen in FIG. 2, the width of the insert slot 44 is less than the width of the opening 20 of the elevator but large enough to allow relative lateral movement between the rod shaft 22 and the insert slot when the elevator is being moved into and out of position. The width of the insert slot must be small enough, however, to allow the surface 46 of the upper insert 36 immediately adjacent the interior portion of the slot 44 to engage the tapered or flared head portion 26 of the sucker rod so as to provide a seat for the head portion of the rod during lifting or lowering of the rod by the elevator. As illustrated, the surface 46 preferably is arcuately formed so as to better conform to the flared head portion 26 of the rod. Typically, the elevator opening is of a size to permit its use with a number of different rod sizes, using inserts of varying sizes to conform to the rod diameter.

Referring to FIG. 2, the sucker rod 24 is typically formed from a steel shaft coated with a layer of plastic coating composition 48 capable of protecting the shaft against corrosive fluids encountered in the well bore. Because the conventional arrangement between an elevator and sucker rod results in harsh contact between the rod coating and the rod seat, the coating 48 is often damaged, thereby exposing the steel rod shaft to the corrosive action of well bore fluids. In accordance with this invention, the steel inserts 36 and 38 are provided with coatings 50 and 52, respectively, which are soft enough to cushion the coating 48 on the sucker rod during a lifting or lowering operation so as not to damage the rod coating 48. The insert coating material should also be tough and strong enough to resist damage due to contact with the sucker rod. Although any coating composition capable of providing these essential functions may be utilized, it has been found that excellent results are obtained with a fusion-bonded nylon coating. The term "fusion bonding" in this case refers to a coating operation wherein the coating composition is applied under pressure to the base material and is caused to strongly adhere to the metal base of the insert. This composition is commercially available under the trademark Rodcoat from ICO Company. The coating thickness may vary depending upon the specific coating composition employed. In order to provide adequate strength and cushioning ability, it has been found that a minimum coating thickness of 10 mils should be applied, with a preferred thickness range of 10 to 40 mils.

The upper and lower inserts 36 and 38 are identical and, while only the upper insert 36 supports the weight of the rod during a lifting or lowering operation, the lower insert 38 assists in holding the rod steady and preventing it from swaying. Since the rod coating in the contact area between the lower insert and the sucker rod is also susceptible to potential damage, it is preferred to coat the lower insert as well.

It will be recognized that only the portions of the inserts which come into contact with the sucker rod need be provided with a protective coating. Thus in the case of the upper insert 36, the surface surrounding or adjacent to the sucker rod, including the vertical portions of the slot edges and the connecting arcuate portions which contact the flared head portion of the sucker rod, must be coated. In the case of the lower insert 38, the vertical edges of the slots surrounding or adjacent to the sucker rod should be coated. In addition, the sides of the slot portions forming the entryway of the elevator opening should be coated because the rod will normally bump or scrape against them during lateral movement of the elevator onto the sucker rod. In practice, because of the difficulty in coating only a relatively small part of the surface area of the inserts and in view of the low cost of coating the inserts, it is more practical to coat the entire insert, thus ensuring that all critical surfaces of an insert are coated. When the coating on an elevator insert becomes worn from use, the insert should be replaced with a newly coated one. The worn insert can then be recoated and subsequently put back into use.

In carrying out the invention, either newly manufactured coated inserts or old inserts which have been coated may be employed. If new coated inserts are used, they can be fabricated to the required slot and elevator recess dimensions. If previously manufactured inserts are coated and employed, the added thickness of the coating will have to be taken into account. Thus an insert which was originally manufactured with a $\frac{7}{8}$ inch slot may, after coating, be suitable for use in assemblies requiring a $\frac{3}{4}$ inch slot. If a previously manufactured insert is coated over its entire surface as contemplated, the added coating thickness may increase the diameter of the insert to an extent requiring the elevator recess to be machined to a larger diameter in order to accept the coated insert.

It will be understood that while only one elevator design and one insert design have been illustrated, the insert coating of the invention may be employed in connection with other specific elevator and insert arrangements.

It should now be apparent that the invention is not necessarily limited to all the specific details described in connection with the preferred embodiment, but that changes to certain features of the preferred embodiment which do not alter the overall basic function and concept of the invention may be made by those skilled in the art without departing from the spirit and scope of the invention, as defined in the appended claims.

What is claimed is:

1. In a rod elevator assembly having an opening therethrough for receiving a rod to be lifted from or lowered into a well, and means for receiving an insert adapted to engage the rod when the rod is lifted or lowered, the rod having a corrosion protective coating thereon, the improvement comprising:

an insert in the insert receiving means, said insert having an elongated slot terminating in the interior of the insert in a rod seat; and a coating on said insert substantially covering at least said rod seat, said coating being capable of resisting damage upon contact with the coated rod during lifting or lowering thereof and being sufficiently soft to cushion the rod during lifting and lowering to prevent damage to the coating on the rod.

2. The improvement of claim 1, wherein the rod comprises a relatively thin shaft and a relatively thick head portion at the upper end of the shaft, the slot in the rod seat being wide enough to allow entry of the shaft of the coated rod but being narrower than the head portion of the rod to enable the rod seat to engage the head portion of the rod when lifting or lowering the rod.

3. The improvement of claim 2, wherein the head portion of the rod comprises a tapered surface and wherein the rod seat comprises an arcuate surface for engaging the tapered surface of the rod.

4. The improvement of claim 3, wherein the means in the elevator assembly for receiving the insert includes a recess and means for securing the insert in the recess.

5. The improvement of claim 4, wherein the elevator assembly includes a second recess spaced along the length of the rod from the aforesaid recess and a second insert secured in the second recess, the second insert having an elongated slot terminating in a portion adapted to be adjacent the shaft of the coated rod when the elevator assembly is in position to lift or lower the rod, substantially all of said portion of the second insert having a coating thereon similar to the coating on the first-mentioned insert.

6. The improvement of claim 5, wherein said coating on said second insert substantially covers the sides of said elongated slot.

7. The improvement of claim 3, wherein the insert is coated on substantially all surfaces thereof.

8. The improvement of claim 1, wherein the insert has a main body portion comprised of metal, and the coating on the insert comprises nylon which has been bonded to the main body portion of the insert.

9. The improvement of claim 8, wherein the coating on the insert is at least about 10 mils thick.

10. The improvement of claim 9, wherein the coating has a thickness in the approximate range of 10 to 40 mils.

11. The improvement of claim 1, wherein said coating substantially covers the sides of said elongated slot.

12. A rod elevator assembly, comprising:

a main body portion having an opening therethrough for receiving a plastic-coated rod of the type comprising a relatively thin shaft and a relatively thick head portion at the upper end of the shaft;

an insert mounted in the elevator assembly, the insert including an elongated slot terminating in the interior of the insert in a rod seat, the elongated slot being wide enough to allow entry of the shaft of the coated rod but narrower than the head portion of the rod to enable the rod seat to engage the head portion of the rod when lifting or lowering the rod;

the insert having a coating thereon substantially covering at least the rod seat; and the coating on the insert being capable of resisting damage upon contact with the coated rod during lifting or lowering thereof and being capable of cushioning the rod during lifting and lowering to prevent damage to the plastic coating on the rod.

13. The elevator assembly of claim 12, including a second insert mounted in the elevator assembly spaced along the length of the rod from the first-mentioned insert, the second insert having an elongated slot terminating in a portion adapted to be adjacent the shaft of the coated rod when the elevator assembly is in position to lift or lower the rod, said portion of the second insert having a coating thereon similar to the coating on the first-mentioned insert.

14. In a method of lifting or lowering a rod by means of a rod elevator assembly having an opening therethrough for receiving a rod having a corrosion protective coating thereon, the improvement comprising the steps of:

providing an elevator insert having an elongated slot terminating at an interior portion of the insert, a portion of the insert adjacent the slot having a surface adapted to engage and support the rod during the lifting or lowering thereof, at least said surface of the insert being coated with a material capable of resisting damage upon contact with the coated rod during lifting or lowering thereof and being sufficiently soft to cushion the rod during lifting and lowering to prevent damage to the coating on the rod; and installing the coated insert on the rod elevator assembly so that the slot in the insert is in substantial alignment with the opening in the rod elevator assembly.

* * * * *